US011761613B1

(12) United States Patent
Xu

(10) Patent No.: US 11,761,613 B1
(45) Date of Patent: Sep. 19, 2023

(54) LAMP

(71) Applicant: JIANGMEN CITY SHENGDA LIGHTING CO., LTD., Jiangmen (CN)

(72) Inventor: Xiaojun Xu, Jiangmen (CN)

(73) Assignee: JIANGMEN CITY SHENGDA LIGHTING CO., LTD., Jiangmen (CN)

( * ) Notice: Subject to any disclaimer, the term of this patent is extended or adjusted under 35 U.S.C. 154(b) by 10 days.

(21) Appl. No.: 17/836,988

(22) Filed: Jun. 9, 2022

(30) Foreign Application Priority Data

Apr. 27, 2022 (CN) ..... 202221016808.5

(51) Int. Cl.

| | |
|---|---|
| ***F21V 19/00*** | (2006.01) |
| ***F21V 23/00*** | (2015.01) |
| ***F21Y 113/10*** | (2016.01) |
| ***F21Y 115/10*** | (2016.01) |

(52) U.S. Cl.
CPC ..... *F21V 19/001* (2013.01); *F21V 23/001* (2013.01); *F21Y 2113/10* (2016.08); *F21Y 2115/10* (2016.08)

(58) Field of Classification Search
CPC ..... F21V 19/001; F21V 23/001
See application file for complete search history.

(56) References Cited

U.S. PATENT DOCUMENTS

| | | | | |
|---|---|---|---|---|
| 2016/0258580 | A1* | 9/2016 | Sun | F21K 9/232 |
| 2018/0139824 | A1* | 5/2018 | Lin | H05B 45/10 |
| 2019/0032858 | A1* | 1/2019 | Cao | F21K 9/238 |
| 2019/0063702 | A1* | 2/2019 | Miskin | F21S 9/022 |

* cited by examiner

*Primary Examiner* — Bryon T Gyllstrom

(57) ABSTRACT

The present disclosure is based on the characteristic that the LED chip emits light when the polarity at each electrode of a LED chip is the same as the polarity of the respective electrode of the power supply to which the electrode of the LED chip is connected. The LED chip sets each with a respective color temperature are connected in opposite manner to two conductive members that are electrically connected to positive and negative electrodes of a power supply. After the power supply is turned on, the LED chip set having the polarity at each electrode the same as the polarity of the respective conductive member to which the electrode connects can emit light, and the LED chip set having the polarity at each electrode opposite to the polarity of the respective conductive member to which the electrode connects can not emit light.

11 Claims, 11 Drawing Sheets

LAMP

CROSS-REFERENCE TO RELATED APPLICATIONS

The present application claims foreign priority of Chinese Patent Application No. 202221016808. 5, filed on Apr. 27, 2022 in the China National Intellectual Property Administration, the contents of all of which are hereby incorporated by reference.

TECHNICAL FIELD

The present disclosure relates to a field of lighting equipment, in particular to a lamp with switchable color temperatures.

BACKGROUND

A lamp with switchable color temperatures emits two or more kinds of light each with a respective color temperature, and is widely used in various fields.

In existing technology, typically the lamp with switchable color temperatures has a plurality of LED chip sets each corresponding to a respective power supply. Each LED chip set is controlled to emit light or not by switching on or off the respective power supply.

However, such the lamp requires a plurality of power supplies, resulting in a complex structure and a high cost.

SUMMARY

The present disclosure aims to provide a lamp with switchable color temperatures, which has a simple structure and a lower cost.

In order to achieve the above object, the present disclosure provides the following technical schemes.

A lamp is provided and includes a first conductive member, a second conductive member, a first LED chip set, and a second LED chip set. A color temperature of light emitted by the first LED chip set is different from a color temperature of light emitted by the second LED chip set. The first LED chip set has a positive electrode electrically connected to the first conductive member and a negative electrode electrically connected to the second conductive member. The second LED chip set has a positive electrode electrically connected to the second conductive member and a negative electrode electrically connected to the first conductive member. The first conductive member is electrically connected to a positive electrode of a power supply, and the second conductive member is electrically connected to a negative electrode of the power supply.

Compared with the existing technology, the lamp according to the present disclosure is provided with two LED chip sets each having a respective color temperature, and two conductive members electrically connected to the positive and negative electrodes of the power supply. The polarities of the two LED chip sets electrically connected to the same conductive member is opposite. After the power supply is turned on, the first LED chip set emits light as the polarity of each electrode of the first LED chip set is the same as the polarity of the corresponding connected electrode of the power supply, the second LED chip set does not emit light as the polarity of each electrode of the second LED chip set is opposite to the polarity of the corresponding connected electrode of the power supply. In this case, the color temperature of the light emitted by the lamp is that the color temperature of the light emitted by the first chip set. When the polarities of both electrodes of the power supply are switched, the first LED chip set does not emit light as the polarity of each electrode of the first LED chip set is opposite to the polarity of the corresponding connected electrode of the power supply, the second LED chip set emits light as the polarity of each electrode of the second LED chip set is the same as the polarity of the corresponding connected electrode of the power supply. In this case, the color temperature of the light emitted by the lamp is that the color temperature of the light emitted by the second chip set. The switching of the polarities of both electrodes of the power supply changes the light emission of the two LED chip sets, thereby realizing the switching of the two color temperatures. Compared with a lamp having a plurality of LED chip sets each corresponding to a respective power supply, the lamp in the present disclosure has a simpler structure, requires only one external power supply, and does not require an additional control switch or control chip, and has a lower cost.

In one embodiment, the first LED chip set includes a first LED chip or a plurality of first LED chips, all positive electrodes of the plurality of first LED chips are electrically connected to the first conductive member, and all negative electrodes of the plurality of first LED chips are electrically connected to the second conductive member. The second LED chip set includes a second LED chip or a plurality of second LED chips, all positive electrodes of the plurality of second LED chips are electrically connected to the second conductive member, and all negative electrodes of the plurality of second LED chips are electrically connected to the first conductive member.

In one embodiment, at least one first LED chip sets are provided, all positive electrodes of the at least one first LED chip sets are electrically connected to the first conductive member, and all negative electrodes of the at least one first LED chip sets are electrically connected to the second conductive member.

In one embodiment, the lamp further includes a resistor connected in series with the first LED chip set.

In one embodiment, at least one second LED chip sets are provided, all positive electrodes of the at least one second LED chip sets are electrically connected to the second conductive member, and all negative electrodes of the at least one second LED chip sets are electrically connected to the first conductive member.

In one embodiment, the lamp further includes a resistor connected in series with the second LED chip set.

In one embodiment, at least one first LED chip sets are provided, all positive electrodes of the at least one first LED chip sets are electrically connected to the first conductive member, and all negative electrodes of the at least one first LED chip sets are electrically connected to the second conductive member. At least one second LED chip sets are provided, all positive electrodes of the at least one second LED chip sets are electrically connected to the second conductive member, and all negative electrodes of the at least one second LED chip sets are electrically connected to the first conductive member.

In one embodiment, the lamp further includes a half-bridge drive integrated circuit (IC) which has two output terminals electrically connected to the first conductive member and the second conductive member, respectively, and is configured to change polarities of the power supply according to a set frequency, and the set frequency is greater than a refresh frequency of human eyes.

In one embodiment, the lamp further includes a mounting base mounting the first conductive member and the second conductive member, and a housing fixed to the mounting base.

BRIEF DESCRIPTION OF THE DRAWINGS

In order to describe the technical solutions in the embodiments of the present disclosure more clearly, the accompanying drawings for description of the embodiments will be briefly introduced below. It should be appreciated that the accompanying drawings in the following description are merely some embodiments of the present disclosure, and other drawings may be conceivable from these drawings without creative effort for those skilled in the art.

DETAILED DESCRIPTION

Figure 1:
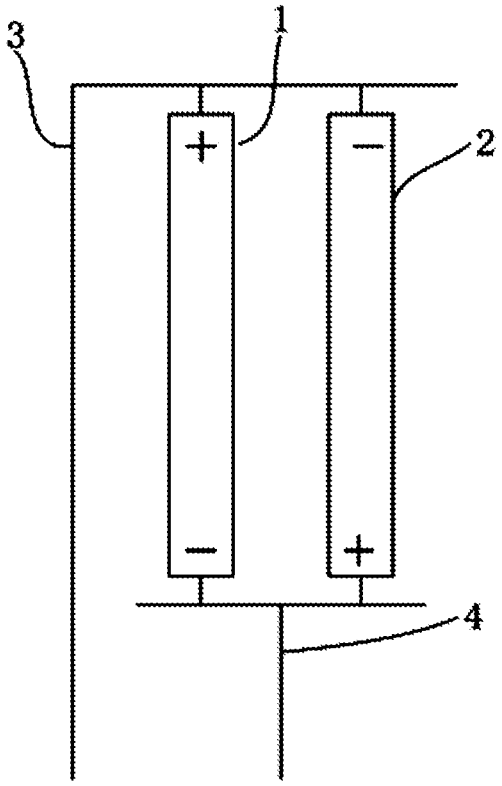
FIG. 1 is a schematic structural diagram of an embodiment.

For ease of understanding, some embodiments of the present disclosure will be described in detail below with reference to the accompanying drawings. It should be appreciated that the present disclosure may be implemented in many different forms and is not limited to the embodiments described herein. Rather, these embodiments are provided merely for the purpose of providing a more thorough understanding of the present disclosure.

It should be noted that when an element is referred to as being "connected" or "fixed" to another element, the element may be connected or fixed to the other element directly or through an intermediate element.

Unless otherwise defined, all terms used herein have the same meanings as those generally understood by those skilled in the art. The terms used in the description of the present disclosure are for the purpose of describing specific embodiments only and are not intended to limit the present disclosure. The terms "and/or" used herein include any and all combinations of one or more related listed items.

Terms in the claims, description and drawings of the present disclosure, such as "first" and "second" and the like are used only to distinguish one entity/operation/object from another entity/operation/object, and does not necessarily indicate any relationships or orders between them.

Switching between the color temperatures of the typical lamp is achieved by using a control circuit and a plurality of power supplies. For example, in a lamp having three LED chips each of a respective color temperature, each LED chip is connected to a respective power supply. For emitting light with a certain color temperature, the lamp is controlled to only turn on the power supply of the corresponding LED chip and cut off the power supplies of the other two LED chips. This, although achieves switching between the color temperatures, but results in a complex structure requiring more components and a high cost.

The present disclosure is based on the characteristic that the LED chip emits light when the polarity at each electrode of a LED chip is the same as the polarity of the respective electrode of the power supply to which the electrode of the LED chip is connected. The LED chip sets each with a respective color temperature are connected in opposite manner to two conductive members that are electrically connected to positive and negative electrodes of a power supply. After the power supply is turned on, the LED chip set having the polarity at each electrode the same as the polarity of the respective conductive member to which the electrode connects can emit light, and the LED chip set having the polarity at each electrode opposite to the polarity of the respective conductive member to which the electrode connects can not emit light. In this way, the light emission of the two LED chip sets is changeable by switching the polarities of both electrodes of the power supply, to achieve switching of two color temperatures. The structure of the lamp is very simple, and the cost therefor is lower than the existing lamps.

As shown in FIG. 1, a lamp with switchable color temperatures includes a first conductive member 3, a second conductive member 4, a first LED chip set 1, and a second LED chip set 2. The first LED chip set 1 has a positive electrode electrically connected to the first conductive member 3, and a negative electrode electrically connected to the second conductive member 4. The second LED chip set 2 has a positive electrode electrically connected to the second conductive member 4, and a negative electrode electrically connected to the first conductive member 3. The first conductive member 3 is electrically connected to a positive electrode of a power supply, and the second conductive member 4 is electrically connected to a negative electrode of the power supply.

The LED chip set includes one LED chip or a plurality of LED chips connected in series or in parallel, or some in series and some in parallel. Electrodes of all the LED chips in one LED chip set having the same polarity are connected to the same conductive member to ensure normal use of the LED chip set. For example, the positive electrodes of all the LED chips in one LED chip set are electrically connected to the first conductive member 3.

In addition, the LED chip set may be formed by a plurality of LED chips directly connected in series or in parallel to form an LED chip set, or by a plurality of LED chips may be indirectly connected in parallel. For example, a plurality of first LED chips 11 and a plurality of second LED chips 21 are arranged alternately at intervals. The first LED chips 11 and the second LED chips 21 are mounted in opposite polarities. The plurality of first LED chips 11 are indirectly connected in parallel to form the first LED chip set 1.

In this embodiment, the electrical connection refers to the connection of two elements or structures by wiring, soldering, or other electronic components. The conductive member is made of conductive metal, may be a metal support, may be a conductive circuit in a circuit board, or other structure capable of powering the LED chip set.

In this embodiment, two LED chip sets each having a respective color temperature are provided, and the polarity at each electrode of one LED chip set is the same as the polarity of the electrode of the corresponding conductive member to which the electrode of one LED chip set is connected to. As a whole, the first LED chip set and the second LED chip set are connected in parallel, although the LED chips in the LED chip set may be connected in series or in parallel, and a plurality of the LED chip sets may be connected in series or in parallel.

Figure 2:
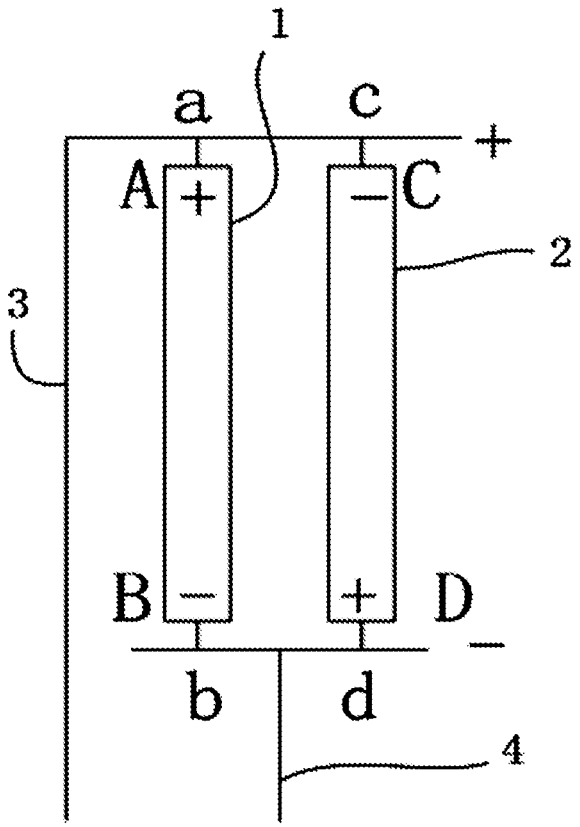
FIG. 2 is a schematic structural diagram of an embodiment.
Figure 3:
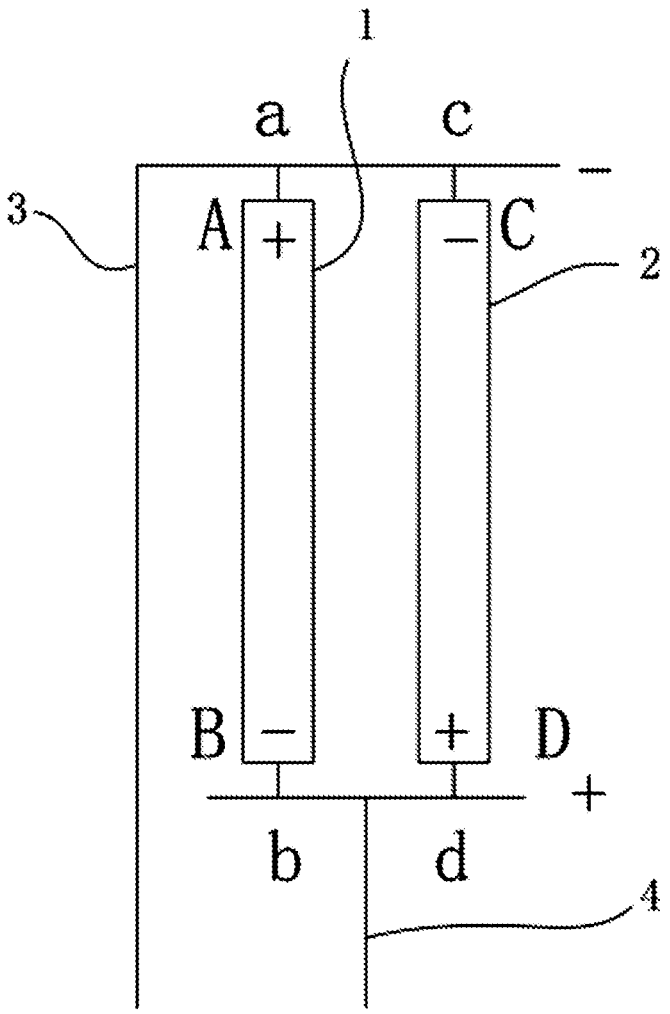
FIG. 3 is a schematic structural diagram of an embodiment.

For example, as shown in FIG. 2, the first LED chip set 1 has a positive electrode 'A' of polarity connecting to a positive electrode 'a' of the first conductive member 3, and a negative electrode 'B' connecting to a negative electrode 'b' of the second conductive member 4. In this case, the polarity of each electrode of the first LED chip set 1 is the same as the polarity of the correspondingly connected electrode of the respective conductive member, so that the first LED chip set 1 can emit light with its corresponding color temperature. The polarity of each electrode of the second LED chip set 2 is opposite to the polarity of the correspondingly connected electrode of the respective conductive member. For example, the second LED chip set 2 has a negative electrode 'C' connecting to a positive electrode 'c' of the second conductive member 3. In this case, the polarity of each electrode of the second LED chip set 2 is opposite to the polarity of the correspondingly connected electrode of the respective conductive member, so that the second LED chip set 2 can not emit light. When the polarities of the two electrodes of the conductive members are switched, as shown in FIG. 3, the polarity of each electrode of the second LED chip set 2 is the same as the polarity of the correspondingly connected electrode of the respective conductive member, and the second LED chip set 2 can emit light with its corresponding color temperature, while the polarity of each electrode of the first LED chip set 1 is opposite to the polarity of the correspondingly connected electrode of the respective conductive member, and the first LED chip 1 can not emit light.

The polarities of both electrodes of the conductive members may be switched by a controller which has two output terminals electrically connected to the two conductive members. The controller receives a polarity switching signal and switches the polarities output to the two conductive members. Alternatively, the polarities of both electrodes of the conductive members may be switched manually. The controller may connect with a plurality of lamps applicable in billboards and other products that require a plurality of LED lamps, and can control a plurality of LED lamps simultaneously.

With the two LED chip sets each having a respective color temperature and connecting to the conductive members oppositely, the LED chip set having the polarity at each electrode the same as the correspondingly connected electrode of the respective conductive member can emit light, and the other LED chip set cannot emit light. When the polarities of both electrodes of the conductive members are switched, the light emission of the two LED chip sets is reversed, so that switching of the color temperatures are achieved. Compared with a lamp having a plurality of LED chip sets each corresponding to a respective power supply, the lamp in the present disclosure has a simpler structure, requires only one external power supply, and does not require an additional control switch or control chip, and has a lower cost.

In one embodiment, the first LED chip set 1 includes one or more first LED chips 11, all positive electrodes of the first LED chips 11 are electrically connected to the first conductive member 3, and all negative electrodes of the first LED chips 11 are electrically connected to the second conductive member 4. The second LED chip set 2 includes one or more second LED chips 21, all positive electrodes of the second LED chips 21 are electrically connected to the second conductive member 4, and all negative electrodes of the second LED chips 21 are electrically connected to the first conductive member 3.

Figure 4:
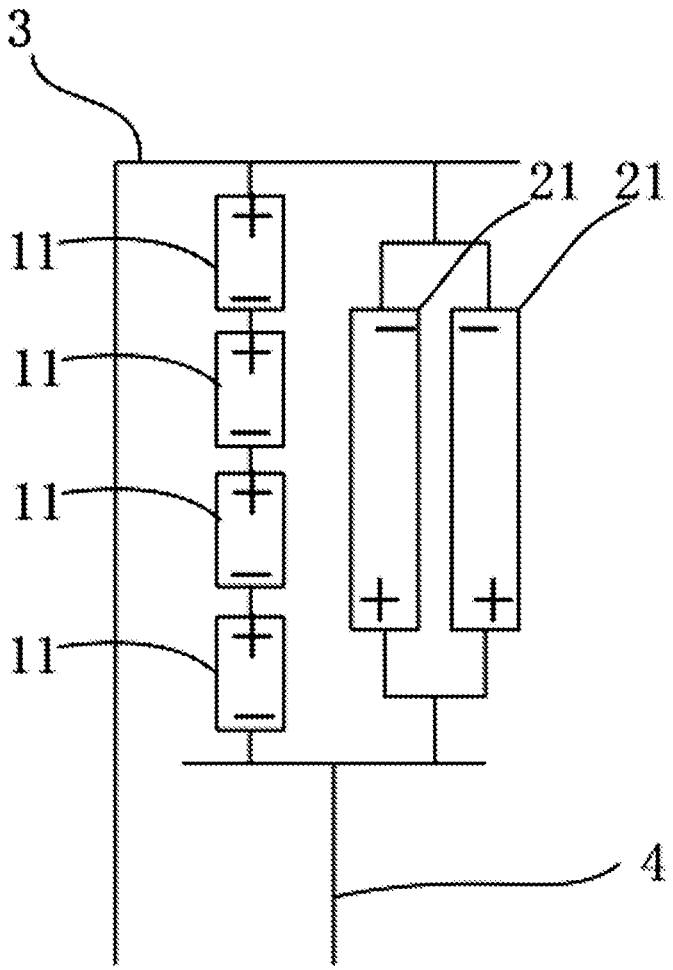
FIG. 4 is a schematic structural diagram of an embodiment.

The LED chip set includes one LED chip or a plurality of LED chips connected in series or in parallel, or some in series and some in parallel. Electrodes of all the LED chips in one LED chip set having the same polarity are connected to the same conductive member to ensure normal use of the LED chip set. For example, as shown in FIG. 4, the first LED chip set 1 includes four first LED chips 11 connected in series, the second LED chip set 2 includes two second LED chips 21 connected in parallel. Electrodes of all the LED chips in the first LED chip set 1 having the same polarity are connected to the same conductive member. Electrodes of all the LED chips in the second LED chip set having the same polarity are connected to the same conductive member. In addition, the LED chips in the LED chip set may be connected in series or in parallel, or some in series and some in parallel, as long as to ensure that electrodes of all the LED chips in one LED chip set having the same polarity are connected to the same conductive member.

In one embodiment, one or more first LED chip sets 1 are provided. All positive electrodes of the one or more first LED chip sets 1 are electrically connected to the first conductive member 3, and all negative electrodes of the one or more first LED chip sets 1 are electrically connected to the second conductive member 4.

Figure 5:
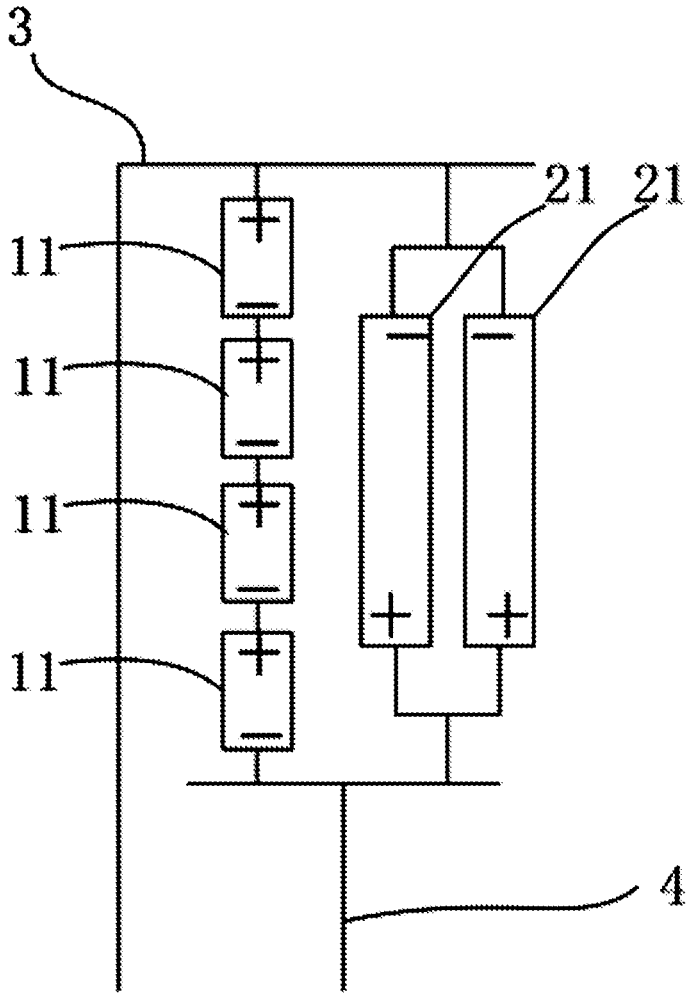
FIG. 5 is a schematic structural diagram of an embodiment.

The number of the first LED chip sets 1 may be one, two, three, or the like, and luminance of light emitted by the lamps with different numbers of LED chip sets may be different. A plurality of identical LED chip sets are connected in series or in parallel, or some in series and some in parallel to the conductive members, with electrodes of all the LED chip sets having the same polarity are connected to the same conductive member. As shown in FIG. 5, two first LED chip sets 1 are connected in parallel to the two conductive members, and the positive electrodes of the two first LED chip sets 1 are connected to the first conductive member 3, and the negative electrodes of the two first LED chip sets 1 are connected to the second conductive member 4. In addition, the plurality of first LED chip sets 1 may be connected to two conductive members in series, or some in series and some in parallel, as long as to ensure that electrodes of all the first LED chip sets 1 having the same polarity are connected to the same conductive member, that is, all positive electrodes are connected to the first conductive member 3 and all negative electrodes are connected to the second conductive member 4.

In one embodiment, the lamp further includes a resistor 5 connected in series with the first LED chip set 1.

Figure 6:
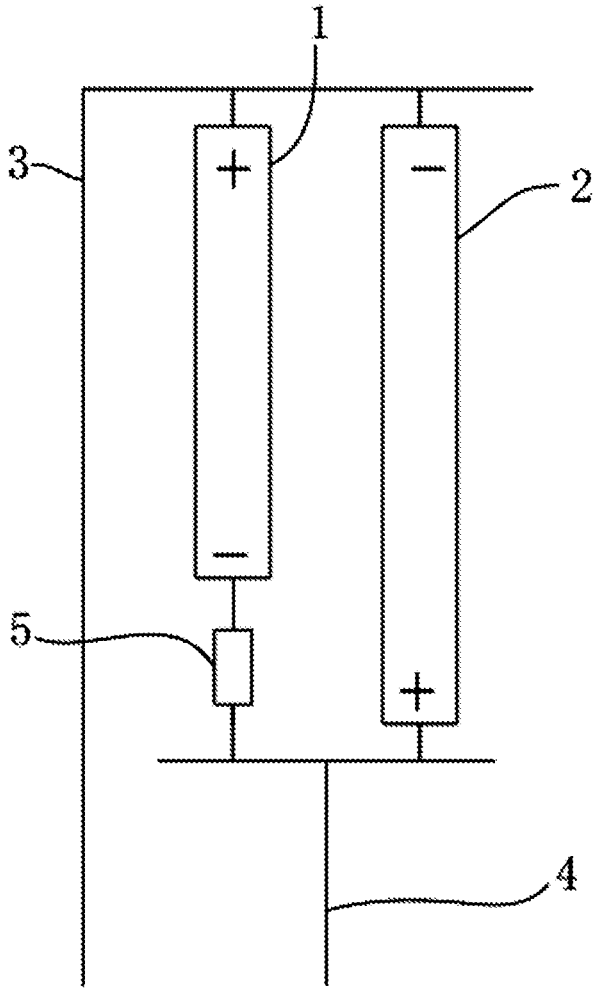
FIG. 6 is a schematic structural diagram of an embodiment.

The resistor 5 may be connected between the first LED chip set 1 and the conductive member for voltage regulation. For example, as shown in FIG. 6, the negative electrode of the first LED chip set 1 is connected to a resistor 5, so that the voltage across the first LED chip set 1 can be decreased. It should be appreciated that more than one resistor 5 may be provided to connect to the first LED chip set 1, and the connection of the resistors 5 is not limited to series connection.

In one embodiment, one or more second LED chip sets 2 are provided. All positive electrodes of the one or more second LED chip sets 2 are electrically connected to the second conductive member 4, and all negative electrodes of the one or more second LED chip sets 2 are electrically connected to the first conductive member 3.

Figure 7:
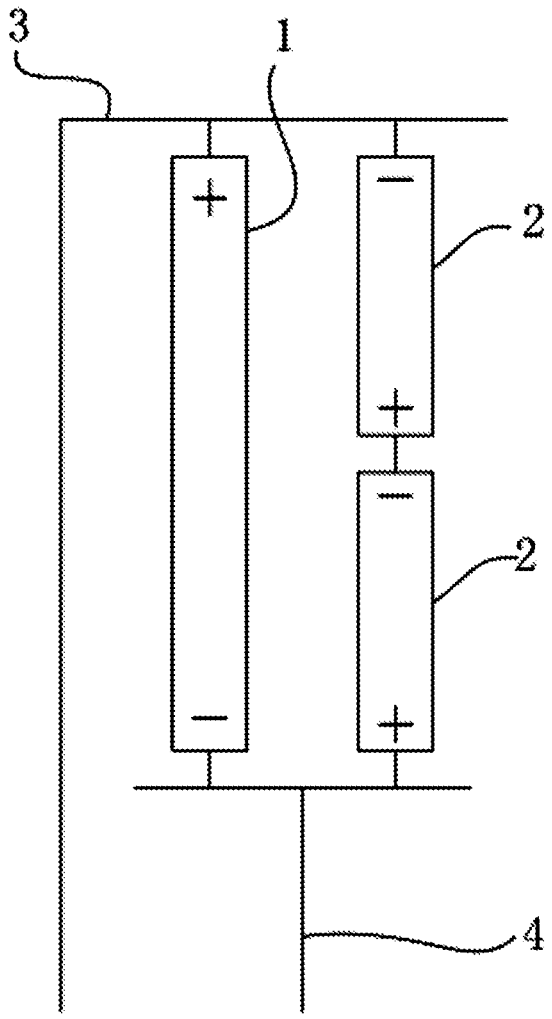
FIG. 7 is a schematic structural diagram of an embodiment.

The number of the second LED chip sets 2 may be one, two, three, or the like, and luminance of light emitted by the lamps with different numbers of LED chip sets may be different. A plurality of identical LED chip sets are connected in series or in parallel, or some in series and some in parallel to the conductive members, with electrodes of all the LED chip sets having the same polarity are connected to the same conductive member. As shown in FIG. 7, two second LED chip sets 2 are connected in series to the two conductive members, and the negative electrodes of the two second LED chip sets 2 are connected to the first conductive member 3, and the positive electrodes of the two second LED chip sets 2 are connected to the second conductive member 4. In addition, the plurality of second LED chip sets 2 may be connected to two conductive members in series, or some in series and some in parallel, as long as to ensure that electrodes of all the second LED chip sets 2 having the same polarity are connected to the same conductive member, that is, all negative electrodes are connected to the first conductive member 3 and all positive electrodes are connected to the second conductive member 4.

In one embodiment, the lamp further includes a resistor 5 connected in series with the second LED chip set 2.

Figure 8:
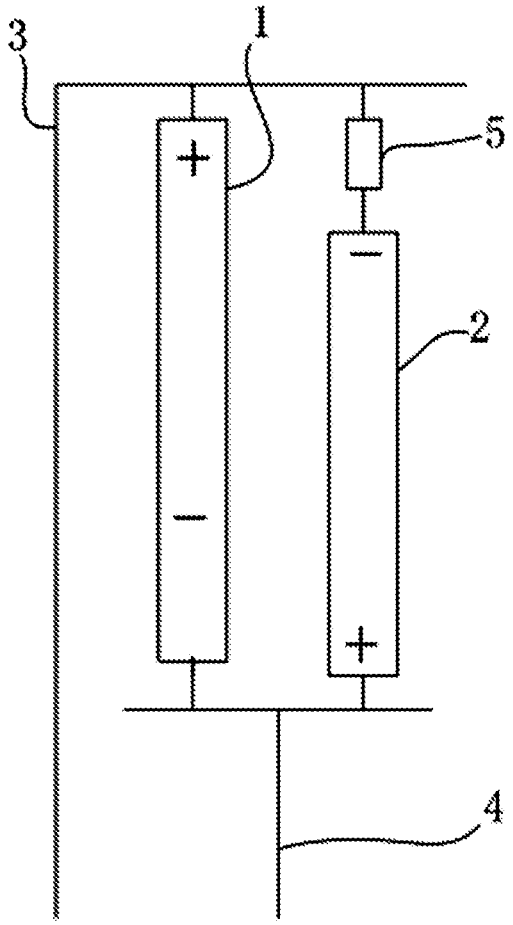
FIG. 8 is a schematic structural diagram of an embodiment.

The resistor 5 may be connected between the second LED chip set 2 and the conductive member for voltage regulation. For example, as shown in FIG. 8, the negative electrode of the second LED chip set 2 is connected to a resistor 5, so that the voltage across the second LED chip set 2 can be decreased. It should be appreciated that more than one resistor 5 may be provided to connect to the second LED chip set 2, and the connection of the resistors 5 is not limited to series connection.

In one embodiment, one or more first LED chip sets 1 are provided, all positive electrodes of the one or more first LED chip sets 1 are electrically connected to the first conductive member 3, and all negative electrodes of the one or more first LED chip sets 1 are electrically connected to the second conductive member 4. One or more second LED chip sets 2 are provided, all positive electrodes of the one or more second LED chip sets 2 are electrically connected to the second conductive member 4, and all negative electrodes of the one or more second LED chip sets 2 are electrically connected to the first conductive member 3.

Figure 9:
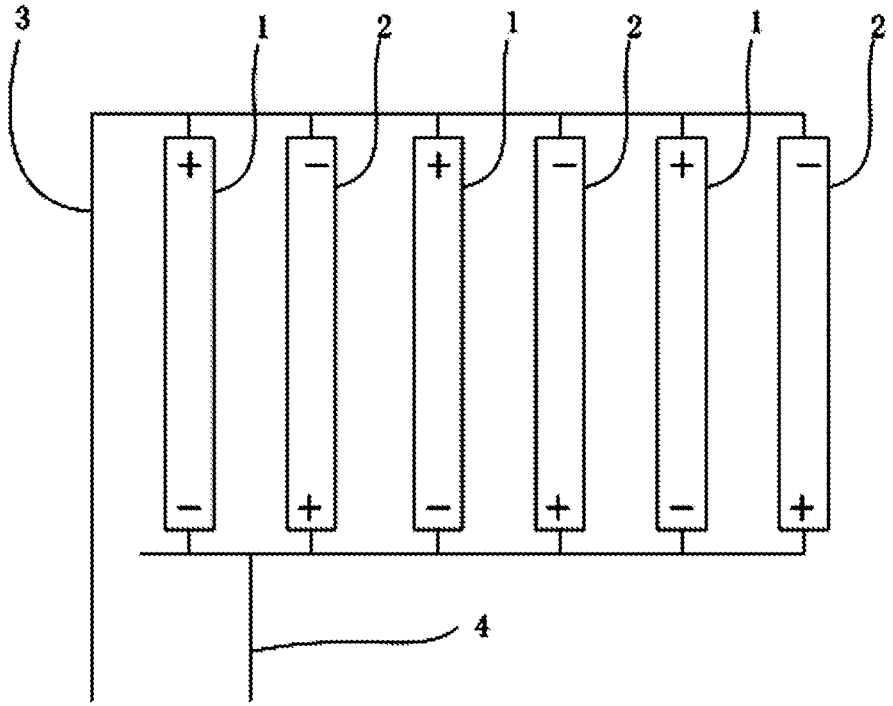
FIG. 9 is a schematic structural diagram of an embodiment.

In the case where a plurality of first LED chip sets 1 and a plurality of second LED chip sets 2 are provided, the first LED chip sets 1 and the second LED chip sets 2 may be arranged alternately at intervals and connected in parallel, as shown in FIG. 9. Electrodes of all the first LED chip sets 1 having the same polarity are connected to the same conductive member. Electrodes of all the second LED chip sets 2 having the same polarity are connected to the same conductive member. The first LED chip set 1 may include one or more LED chips connected in series or in parallel, or some in series and some in parallel, and electrodes of all the LED chips in one LED chip set having the same polarity are connected to the same conductive member. The second LED chip set 2 may include one or more LED chips connected in series or in parallel, or some in series and some in parallel, and electrodes of all the LED chips in one LED chip set having the same polarity are connected to the same conductive member. And the first LED chip set 1 and the second LED chip set 2 may be connected in parallel in one filament, i.e., one filament for one lamp, such that one filament can emit light with two different color temperatures that are switchable with switching of the power supply. Alternatively, one set of LED chip sets may be connected in one filament, multiple sets of LED chip sets may be connected in multiple filaments, or one set of LED chip sets may be connected in one filament, and multiple sets of LED chips may be connected in one filament.

In one embodiment, the lamp further includes a half-bridge drive integrated circuit (IC) which has two output terminals electrically connected to the first conductive member 3 and the second conductive member 4, respectively and changes the polarities of both electrodes of the power supply according to a set frequency. The set frequency is greater than a refresh frequency of human eyes.

The input terminals of the half-bridge drive IC may be directly or indirectly connected to the power supply. The two output terminals of the half-bridge drive IC are electrically connected to the first conductive member 3 and the second conductive member 4, respectively. Through the half-bridge drive IC, the polarities of both electrodes of the power supply can be changed for thousands of times within one second, that is, the polarities of the first conductive member 3 and the second conductive member 4 are switchable, thereby changing the light emission of the first LED chip set 1 and the second LED chip set 2. The refresh frequency of human eyes is about 60 HZ, and the average refresh frequency of eyes of pilots is 220 HZ, those are far lower than the frequency of the half-bridge drive IC changing the polarities of both electrodes of the power supply. In this embodiment, the frequency is set to 10000 times per second, and the half-bridge drive IC changes polarities of the conductive members so that two LED chip sets each having a respective color temperature emit light alternately 5000 times in one second without flickers, and the human eyes feel that the two LED chip sets emit light simultaneously to form mixed light having a third color temperature.

In one embodiment, the lamp further includes a mounting base 6 for mounting the first conductive member 3 and the second conductive member 4, and a housing 7 fixed to the mounting base 6.

Figure 10:
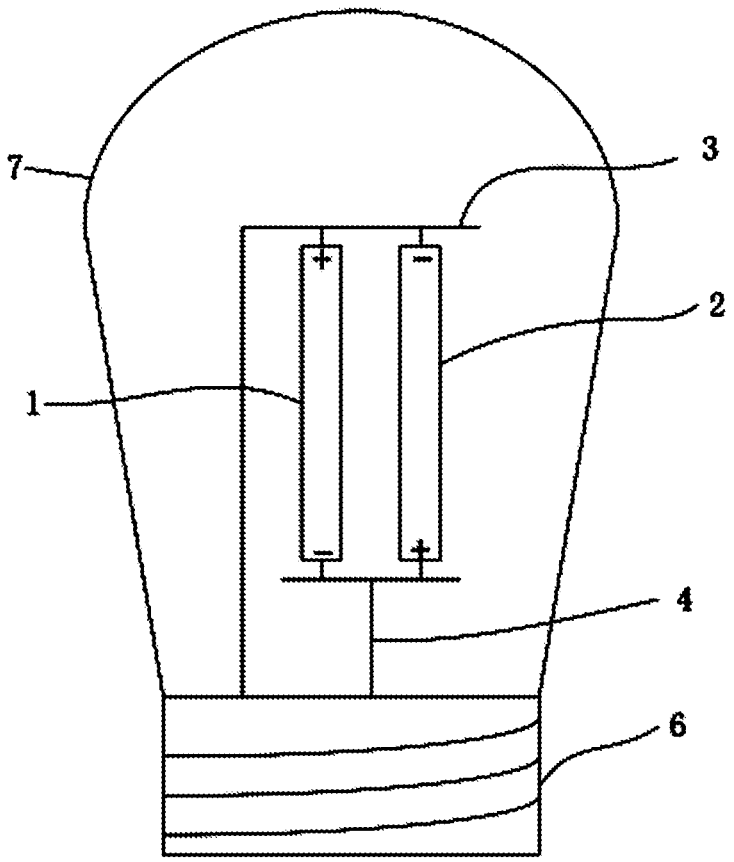
FIG. 10 is a schematic structural diagram of an embodiment.
Figure 11:
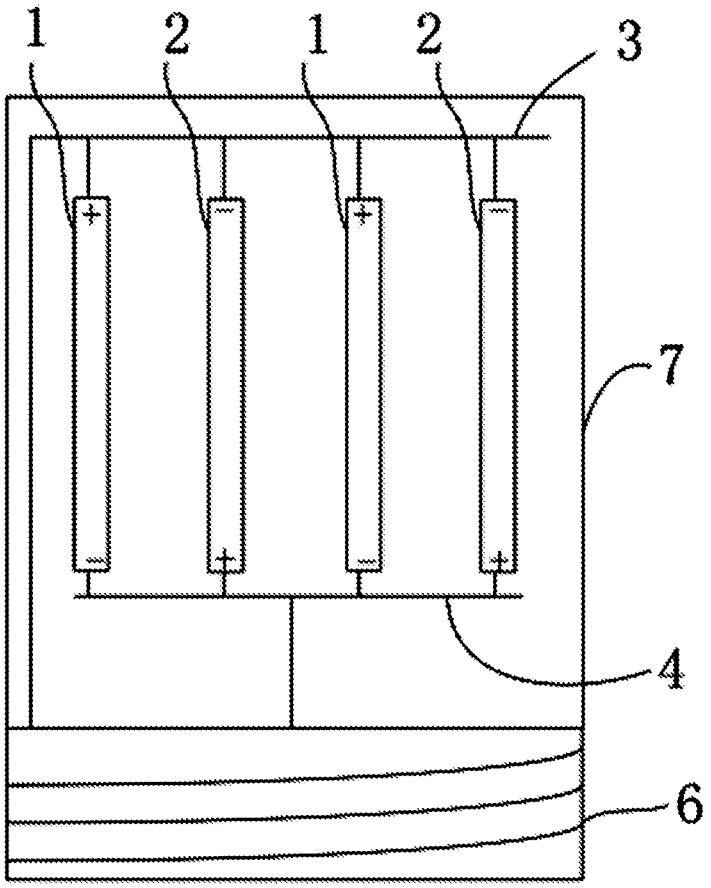
FIG. 11 is a schematic structural diagram of an embodiment.

As shown in FIG. 10, the first conductive member 3 and the second conductive member 4 are fixed to the mounting base 6, and the mounting base 6 matches a lamp holder, for example, a threaded holder such as E12, E17, E26 and E27. In addition, the lamp further includes a housing 7 for protecting the internal circuits and components and preventing electric shock. The housing 7 may be made of glass, plastic, or the like, or may be a protective epoxy covered on the LED chip sets. In the present disclosure, besides the strip-shaped filament shown in FIG. 10, the lamp may be a corn-shaped LED lamp as shown in FIG. 11 in which a plurality of first LED chip sets 1 and a plurality of second LED chip sets 2 are spaced and connected in parallel. The LED chip set includes one LED chip or a plurality of LED chips connected in series or in parallel, or some in series and some in parallel, with electrodes of all the LED chips in one LED chip set having the same polarity are connected to the same conductive member. The shape of the housing 7 is not limited herein and may be designed as required. In the present disclosure, the conductive member may be a metal rack for fixing the LED chip sets and connecting them to the power supply. A circuit board with conductive wires may be used, the LED chip sets or the LED chips may be welded on the circuit board, and the conductive wires may be used for connecting the LED chip sets or the LED chips to the power supply.

It should be appreciated that there are other implementations in which the conductive members connect two LED chip sets or LED chips, each oppositely connected to the conductive members, to the power supply to power on one LED chip set or LED chip and power off the other. And by changing the polarities of the conductive members, the light emission of the two LED chip sets or LED chips is changed. The switching between two color temperatures of the lamp is achieved.

The various technical features of the above embodiments may be arbitrarily combined, and not all possible combinations of the various technical features in the above embodiments have been described in order to simplify the description, while those combinations without contradiction should fall within the scope of the present disclosure.

The above-described embodiments are merely some of embodiments of the present disclosure, but not to be considered as limiting the scope of the patent disclosure. It should be noted that, for those skilled in the art, several modifications and improvements may be made without departing from the concept of the present disclosure, all of which fall within the protection scope of the present disclosure. Therefore, the protection scope of the present disclosure should be subject to the claims.

What is claimed is:

1. A lamp with switchable color temperatures, comprising a first conductive member, a second conductive member, a first LED chip set, and a second LED chip set, wherein a color temperature of light emitted by the first LED chip set is different from a color temperature of light emitted by the second LED chip set, the first LED chip set has a positive electrode electrically connected to the first conductive member and a negative electrode electrically connected to the second conductive member, the second LED chip set has a positive electrode electrically connected to the second conductive member and a negative electrode electrically connected to the first conductive member, the first conductive member is electrically connected to a positive electrode of a power supply, and the second conductive member is electrically connected to a negative electrode of the power supply;

wherein the lamp further comprises a controller having two output terminals electrically connected to the first conductive member and the second conductive member, respectively, the controller is configured to receive a polarity switching signal and switch polarities output to the first conductive member and the second conductive member;

wherein the first LED chip set includes a first LED chip or a plurality of first LED chips, all positive electrodes of the plurality of first LED chips are electrically connected to the first conductive member, and all negative electrodes of the plurality of first LED chips are electrically connected to the second conductive member;

wherein the second LED chip set includes a second LED chip or a plurality of second LED chips, all positive electrodes of the plurality of second LED chips are electrically connected to the second conductive member, and all negative electrodes of the plurality of second LED chips are electrically connected to the first conductive member;

wherein the lamp further comprises a half-bridge drive integrated circuit (IC) which has two output terminals electrically connected to the first conductive member and the second conductive member, respectively, and is configured to change polarities of the power supply according to a set frequency, and the set frequency is greater than a refresh frequency of human eyes; and wherein the lamp is switchable between a first mode and a second mode through the controller, the lamp gives out light with the first color temperature in the first mode and gives out light with the second color temperature in the second mode, and the lamp is further switchable to a third mode as the half-bridge drive integrated circuit is turned on to switch light emission of the first LED chip set and the second LED chip set in the set frequency.

2. A lamp switchable to one of at least a first color temperature, a second color temperature and a third color temperature, comprising a first conductive member configured to electrically connect a positive electrode of a power supply;

a second conductive member configured to electrically connect to a negative electrode of the power supply;

a first LED chip set configured to emit light with the first color temperature, wherein the first LED chip set has a positive electrode electrically connected to the first conductive member and a negative electrode electrically connected to the second conductive member; and a second LED chip set configured to emit light with the second color temperature that is different from the first color temperature, wherein the second LED chip set has a positive electrode electrically connected to the second conductive member and a negative electrode electrically connected to the first conductive member;

wherein the lamp is switchable to the third color temperature where the first LED chip set and the second LED chip set emit light alternately in a set frequency.

3. The lamp according to claim 2, further comprising a half-bridge drive integrated circuit (IC) having two output terminals electrically connected to the first conductive member and the second conductive member, respectively, to switch light emission of the first LED chip set and the second LED chip set in the set frequency.

4. The lamp according to claim 3, wherein the first LED chip set and the second LED chip set emit light alternately 5000 times in one second.

5. The lamp according to claim 3, the half-bridge drive integrated circuit (IC) is configured to change polarities of the power supply to switch light emission of the first LED chip set and the second LED chip set for thousands of times.

6. The lamp according to claim 3, further comprising a controller having two output terminals electrically connected to the first conductive member and the second conductive member, respectively, the controller is configured to switch polarities output to the first conductive member and the second conductive member in such a wat to switch the lamp between the first color temperature and the second color temperature.

7. The lamp according to claim 2, wherein the first LED chip set includes a first LED chip or a plurality of first LED chips, all positive electrodes of the plurality of first LED chips are electrically connected to the first conductive member, and all negative electrodes of the plurality of first LED chips are electrically connected to the second conductive member; and the second LED chip set includes a second LED chip or a plurality of second LED chips, all positive electrodes of the plurality of second LED chips are electrically connected to the second conductive member, and all negative electrodes of the plurality of second LED chips are electrically connected to the first conductive member.

8. The lamp according to claim 7, wherein at least one first LED chip sets are provided, all positive electrodes of the at least one first LED chip sets are electrically connected to the first conductive member, and all negative electrodes of the at least one first LED chip sets are electrically connected to the second conductive member.

9. The lamp according to claim 8, further comprising a resistor connected in series with the first LED chip set.

10. The lamp according to 7, wherein at least one second LED chip sets are provided, all positive electrodes of the at least one second LED chip sets are electrically connected to the second conductive member, and all negative electrodes of the at least one second LED chip sets are electrically connected to the first conductive member.

11. The lamp according to 10, further comprising a resistor connected in series with the second LED chip set.

* * * * *